US008329265B2

(12) United States Patent
Cook

(10) Patent No.: US 8,329,265 B2
(45) Date of Patent: Dec. 11, 2012

(54) TRANSITION SYNTHETIC SPORTS TURF

(75) Inventor: Charles Cook, Rochester, MI (US)

(73) Assignee: Astroturf, LLC, Dalton, GA (US)

( * ) Notice: Subject to any disclaimer, the term of this patent is extended or adjusted under 35 U.S.C. 154(b) by 0 days.

(21) Appl. No.: 11/144,587

(22) Filed: Jun. 3, 2005

(65) Prior Publication Data

US 2005/0281963 A1 Dec. 22, 2005

Related U.S. Application Data

(60) Provisional application No. 60/580,220, filed on Jun. 16, 2004.

(51) Int. Cl.
*D05C 17/02* (2006.01)
*A41G 1/00* (2006.01)

(52) U.S. Cl. ..... 428/17; 428/95; 428/87; 428/88; 428/82; 428/62; 472/92

(58) Field of Classification Search ..... 428/95, 428/99, 100, 87, 92, 17, 88, 81, 82, 57, 58, 428/61, 62; 404/73, 75; 472/92; 52/511, 52/506.5, 578, DIG. 13
See application file for complete search history.

(56) References Cited

U.S. PATENT DOCUMENTS

| | | | | |
|---|---|---|---|---|
| 1,949,068 | A | | 2/1934 | Achterhof |
| 1,968,809 | A | | 8/1934 | Curtis |
| 3,332,828 | A | | 7/1967 | Faria et al. |
| 3,513,061 | A | | 5/1970 | Vinicki |
| 3,513,062 | A | | 5/1970 | Vinicki |
| 3,551,263 | A | | 12/1970 | Carter et al. |
| 3,573,147 | A | | 3/1971 | Elbert |
| 3,597,297 | A | | 8/1971 | Buchholtz et al. |
| 3,661,687 | A | | 5/1972 | Spinney, Jr. et al. |
| 3,673,056 | A | | 6/1972 | Nadler |
| 3,837,980 | A | | 9/1974 | Nishimura et al. |
| 3,866,267 | A | * | 2/1975 | Poletti ..... 16/8 |
| 3,940,522 | A | | 2/1976 | Wessells |
| 3,995,079 | A | | 11/1976 | Haas, Jr. |
| 4,123,577 | A | | 10/1978 | Port et al. |
| 4,152,473 | A | * | 5/1979 | Layman ..... 428/17 |
| 4,230,752 | A | | 10/1980 | Benedyk |
| 4,265,849 | A | | 5/1981 | Borenstein |
| 4,268,551 | A | | 5/1981 | Moore, Jr. |
| 4,337,283 | A | | 6/1982 | Haas, Jr. |
| 4,356,220 | A | | 10/1982 | Benedyk |

(Continued)

FOREIGN PATENT DOCUMENTS

| | | |
|---|---|---|
| CA | 1 182 484 | 2/1985 |

(Continued)

*Primary Examiner* — Cheryl Juska
(74) *Attorney, Agent, or Firm* — Luedeka Neely Group, P.C.

(57) ABSTRACT

A durable and wear resistant synthetic sports transition turf field having at least two strips with a plurality of fibrillated polypropylene strands tufted within a backing material. The strands are tufted in a wide variety of pile heights, patterns, gauges, and stitch patterns depending upon end use. The backing material consists of at least two layers of a woven material, with the bottommost one coated with a secondary coating used to contain the ends of the plurality of strands. The strips are placed onto a shock layer and coupled together using a hook and loop fastening system. The field is covered with an infill preferably consisting of resilient particles. The field is easily installed and removed and is ideal for use in indoor, multiuse sports and entertainment facilities that require a multitude of different flooring surfaces.

14 Claims, 8 Drawing Sheets

U.S. PATENT DOCUMENTS

| | | | | | |
|---|---|---|---|---|---|
| 4,381,805 | A | | 5/1983 | Troy | |
| 4,389,435 | A | | 6/1983 | Haas, Jr. | |
| 4,396,653 | A | | 8/1983 | Tomarin | |
| 4,426,415 | A | | 1/1984 | Avery | |
| 4,444,815 | A | | 4/1984 | Friedrich | |
| 4,489,115 | A | * | 12/1984 | Layman et al. | 428/62 |
| 4,497,853 | A | | 2/1985 | Tomarin | |
| 4,515,839 | A | | 5/1985 | Broaddus et al. | |
| 4,617,208 | A | | 10/1986 | Cadenhead et al. | |
| 4,637,942 | A | | 1/1987 | Tomarin | |
| 4,649,069 | A | * | 3/1987 | Tone | 428/82 |
| 4,741,065 | A | * | 5/1988 | Parkins | 15/217 |
| 4,755,401 | A | | 7/1988 | Friedrich et al. | |
| 4,766,022 | A | * | 8/1988 | Tone | 428/95 |
| 4,769,895 | A | * | 9/1988 | Parkins | 29/450 |
| 4,813,614 | A | | 3/1989 | Moore et al. | |
| 4,820,566 | A | | 4/1989 | Heine et al. | |
| 4,896,404 | A | | 1/1990 | Garner | |
| 4,902,540 | A | | 2/1990 | Martino | |
| 4,946,719 | A | | 8/1990 | Dempsey | |
| 5,019,194 | A | | 5/1991 | Friedrich | |
| 5,356,344 | A | | 10/1994 | Lemieux | |
| 5,373,667 | A | | 12/1994 | Lemieux | |
| 5,395,467 | A | | 3/1995 | Rogers, Jr. | |
| 5,462,778 | A | | 10/1995 | Ishikawa | |
| 5,601,886 | A | | 2/1997 | Ishikawa | |
| 5,673,513 | A | | 10/1997 | Casimaty | |
| 5,723,195 | A | * | 3/1998 | Pacione | 428/100 |
| 5,794,861 | A | | 8/1998 | Rutherford, Sr. | |
| 5,830,080 | A | | 11/1998 | Reynolds | |
| 5,958,527 | A | | 9/1999 | Prevost | |
| 5,976,645 | A | | 11/1999 | Daluise et al. | |
| 6,048,282 | A | | 4/2000 | Prevost | |
| 6,070,824 | A | | 6/2000 | Du Pont | |
| 6,083,596 | A | * | 7/2000 | Pacione | 428/62 |
| 6,221,445 | B1 | | 4/2001 | Jones | |
| 6,242,062 | B1 | | 6/2001 | De Vries | |
| 6,295,756 | B1 | | 10/2001 | Bergevin | |
| 6,298,624 | B1 | * | 10/2001 | Pacione | 52/511 |
| 6,299,959 | B1 | | 10/2001 | Squires et al. | |
| 6,306,477 | B1 | * | 10/2001 | Pacione | 428/62 |
| 6,334,275 | B1 | | 1/2002 | Egan | |
| 6,338,885 | B1 | | 1/2002 | Prevost | |
| 6,372,310 | B2 | | 4/2002 | De Vries | |
| 6,375,546 | B1 | | 4/2002 | Lemieux | |
| 6,395,362 | B1 | * | 5/2002 | Pacione | 428/45 |
| 6,432,505 | B1 | | 8/2002 | Sweenie et al. | |
| 6,460,303 | B1 | * | 10/2002 | Pacione | 52/311.2 |
| 6,551,689 | B1 | | 4/2003 | Prevost | |
| 6,627,290 | B2 | * | 9/2003 | Wittlinger et al. | 428/95 |
| 6,689,447 | B2 | | 2/2004 | Prevost | |
| 6,723,412 | B2 | | 4/2004 | Prevost | |
| 6,746,752 | B2 | | 6/2004 | Prevost | |
| 6,797,353 | B1 | * | 9/2004 | Pacione | 428/62 |
| 6,802,167 | B2 | * | 10/2004 | Pacione | 52/506.05 |
| 7,155,796 | B2 | * | 1/2007 | Cook | 29/428 |
| 7,185,465 | B2 | * | 3/2007 | Pacione | 52/311.2 |
| 7,185,473 | B2 | * | 3/2007 | Pacione | 52/747.11 |
| 7,189,445 | B2 | * | 3/2007 | Knox | 428/87 |
| 7,194,843 | B2 | * | 3/2007 | Pacione | 52/552 |
| 7,249,913 | B2 | * | 7/2007 | Linville | 404/73 |
| 7,757,457 | B2 | * | 7/2010 | Zah et al. | 52/747.11 |
| 7,838,096 | B2 | * | 11/2010 | Hayes et al. | 428/62 |
| 2001/0017017 | A1 | * | 8/2001 | Pacione | 52/506.05 |
| 2001/0033902 | A1 | | 10/2001 | Seaton | |
| 2002/0028307 | A1 | | 3/2002 | Prevost | |
| 2002/0081399 | A1 | | 6/2002 | Prevost et al. | |
| 2002/0088190 | A1 | * | 7/2002 | Pacione | 52/311.2 |
| 2002/0136846 | A1 | | 9/2002 | Prevost | |
| 2003/0029110 | A1 | * | 2/2003 | Pacione | 52/311.2 |
| 2004/0206036 | A1 | * | 10/2004 | Pervan | 52/578 |
| 2004/0234719 | A1 | * | 11/2004 | Jones | 428/62 |
| 2005/0055976 | A1 | * | 3/2005 | Pacione | 52/745.19 |
| 2005/0281963 | A1 | * | 12/2005 | Cook | 428/17 |
| 2006/0039754 | A1 | * | 2/2006 | Linville | 404/73 |
| 2006/0242901 | A1 | * | 11/2006 | Casimaty et al. | 47/65.9 |
| 2008/0000188 | A1 | * | 1/2008 | Pervan | 52/588.1 |

FOREIGN PATENT DOCUMENTS

| | | |
|---|---|---|
| CA | 2 095 158 | 10/1994 |
| CA | 2 218 314 | 9/1998 |
| CA | 2 363 822 | 9/1998 |
| CA | 2 365 154 | 9/1998 |
| CA | 2 398 167 | 9/1998 |
| CA | 2 247 484 | 3/2000 |
| CA | 2 412 767 | 12/2001 |
| CA | 2 419 565 | 3/2002 |
| CA | 2 420 910 | 3/2002 |
| CA | 2 426 878 | 6/2002 |
| CA | 2 352 934 | 1/2003 |
| CA | 2 393 240 | 1/2003 |
| CA | 2 460 523 | 3/2003 |
| CA | 2 409 637 | 4/2004 |
| JP | 403069704 A | 3/1991 |

* cited by examiner

TRANSITION SYNTHETIC SPORTS TURF

This Application claims priority to U.S. Provisional Patent Application Ser. No. 60/580,220 filed on Jun. 16, 2004, and entitled "Transition synthetic sports turf," the entirety of which is incorporated herein by reference.

TECHNICAL FIELD AND INDUSTRIAL APPLICABILITY OF THE INVENTION

The present invention relates generally to synthetic sports fields and more specifically to a transition synthetic sports turf.

BACKGROUND OF THE INVENTION

Synthetic grass sports surfaces are well known. These surfaces are becoming increasingly popular as replacements for natural grass surfaces in stadiums, playgrounds, golf driving ranges, or any other facilities. The synthetic grass surfaces stand up to wear much better than the natural grass surfaces, do not require as much maintenance, and can be used in partially or fully enclosed stadiums where natural grass cannot typically be grown.

Most synthetic grass surfaces comprise rows of strips or ribbons of synthetic grass-like material, extending vertically from a backing mat with particulate material infill in between the ribbons on the mat. One or more layers of aggregate material are introduced between the backing mat and on top of a smoothed and compacted subgrade. The surfaces are preferably crowned to promote water drainage.

The ribbons of synthetic grass-like material usually extend a short distance above the layer of particulate material and represent blades of grass. The length of these fibers is dictated by the end use of the playing surface. For example, football fields utilize fibers that are longer than golf driving range surfaces.

The particulate material usually comprises sand, as shown by way of example in U.S. Pat. Nos. 3,995,079 and 4,389,435, both to Haas, Jr. The particulate matter can also comprise a mixture of sand and other materials, including rubber infill, as shown, for example, in U.S. Pat. No. 6,338,885 to Prevost. In these systems, the rubber infill and sand together provide resiliency to the synthetic grass surfaces. In addition, the sand particles add weight to hold down the backing material, thus helping to ensure that the strips of synthetic grass do not move or shift during play. In more recent systems, fields have been produced that utilize 100 percent resilient material as infill.

While the growth of synthetic grass surfaces has grown exponentially over the past quarter century, the technology used in forming the grass surfaces and laying the synthetic fields is still relatively new. As such, issues surrounding durability and application techniques still exist.

It is thus highly desirable to produce a transition (i.e. non-permanent) synthetic grass surface that is easily installed and removed.

SUMMARY OF THE INVENTION

The present invention is directed to a transition synthetic grass surface that can be used in all types of end use applications. The present invention is also directed at a method for installing and subsequently removing the transition grass surface in a quick and efficient manner.

The durable and wear resistant synthetic sports field is formed having a plurality of strips of turf, wherein each of the strips have a plurality of fibrillated polypropylene strands tufted within a multilayer woven backing material. The strands are tufted in a wide variety of pile heights, patterns, gauges, and stitch patterns depending upon end use.

The bottommost layer of the multilayer woven backing material is coated with a secondary coating used to contain the ends of the plurality of strands. The strips are rolled onto a layer of an optional shock resistant material that is laid on a substrate such as a flooring material, concrete slab, or a leveled aggregate and dirt subgrade.

The strips are introduced one at a time onto the substrate or shock resistant layer and coupled to the next adjacent strip utilizing a unique combination of hook and loop fastening systems. A resilient infill is introduced onto the strips. The resilient infill is preferably a mixture of ambiently and cryogenically ground rubber material.

To remove the field, each strip is simply unhooked from the next adjacent strip and rolled onto a roller with the infill remaining along the upper surface of the backing material.

Other objects and advantages of the present invention will become apparent upon considering the following detailed description and appended claims, and upon reference to the accompanying drawings.

DETAILED DESCRIPTION AND PREFERRED EMBODIMENTS OF THE INVENTION

Figure 1:
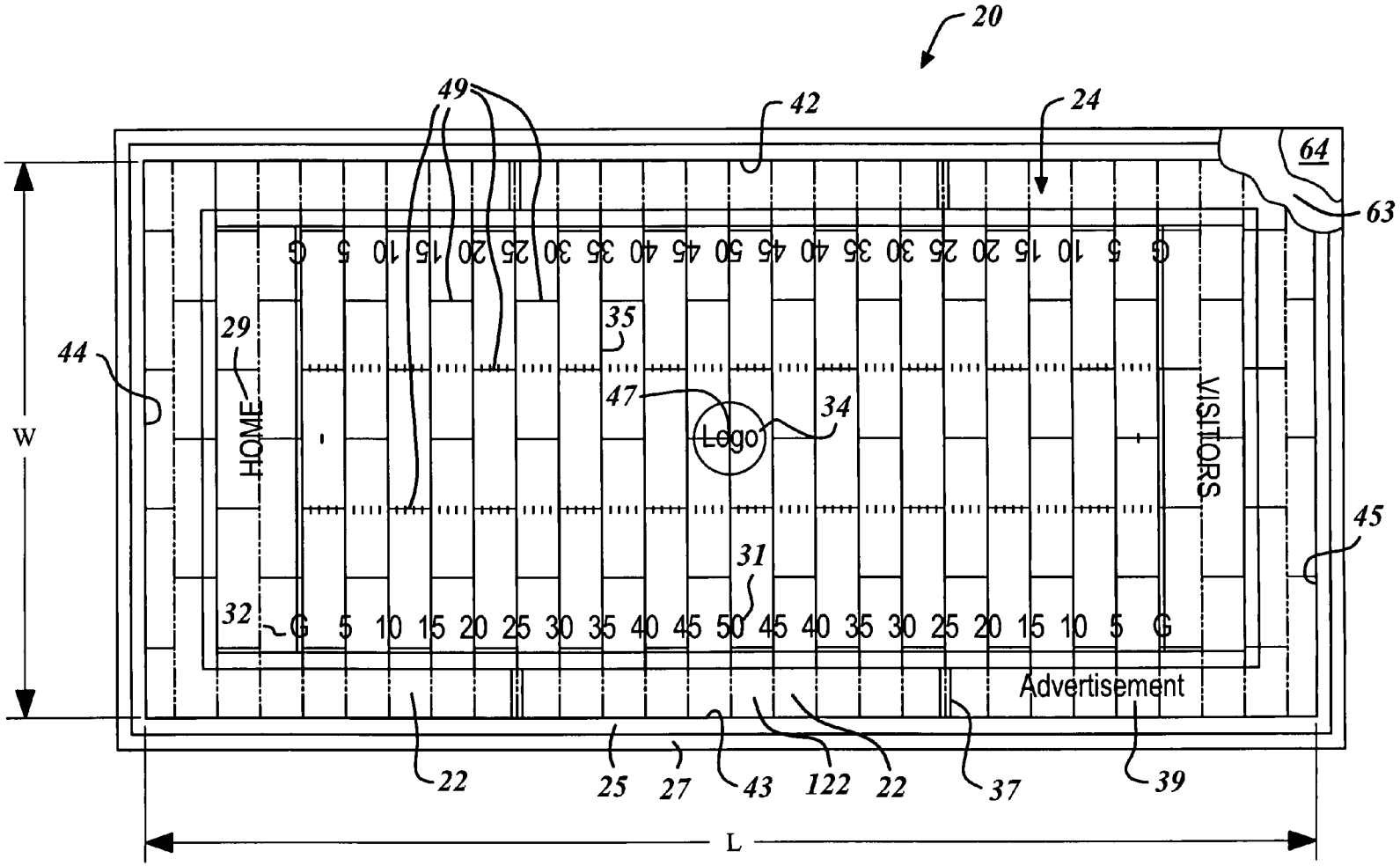
FIG. 1 is a top perspective view of a portion of a sports field according to one preferred embodiment of the present invention.

The present invention describes a transition turf sports playing surface 20, here a football field, according to one preferred embodiment of the present invention. The surface 20 has one or more strips 22 of a synthetic turf grass surface 24 placed lengthwise from one widthwise end 42 to the other widthwise end 43 on either side of a central strip 122. The strips 22, 122 are placed onto a firm and substantially level substrate 64. An optional shock resistant layer 63 may be introduced between the substrate 64 and respective strips 122, 22, to provide additional bounce-back to the playing surface 20 during use.

The substrate 64 for indoor fields is typically a concrete slab or other firm subsurface. For outdoor fields, the substrate material 64 is a compacted and substantially leveled subgrade, which typically consists of layers of various grades of fine and coarse aggregate material designed to enhance drainage. The shock resistant layer 63 preferably consists of a 1-inch thick layer of rubber or nylon.

The number of strips 22 is determined by the overall length L of the field 20 extending a first lengthwise end 44 to a second lengthwise end 45 (shown as the left side and right side on FIG. 1) and by the overall width W from a first widthwise end 42 to a second widthwise end 43 (shown as top side and bottom side, respectively, in FIG. 1). As one of ordinary skill envisions, the direction that the strips 22 are laid is inconsequential as far as the performance of the field and is thus not meant to be limited to the directions described herein. As seen in FIG. 1, however, the strips 22 are preferably laid in a regular pattern such that the seams 49 between strips 22 laid from a first lengthwise end 44 to a second lengthwise side are staggered with respect to the next adjacent row 22.

For outdoor playing surfaces, the playing surface 20 is preferably coupled to a polywood fastener 25 along each respective end 42, 43, 44, 45, that is preferably affixed to a concrete curb 27 and prevents shifting of the playing surface 20 during use. For indoor fields, the polywood fastener 25 and concrete curb 27 are generally unnecessary.

The transition turf playing surface 20 may have a series of numbers 31, letters 32, logos 34, yard lines 35, sideline markings 37, or other markings 39 (collectively features 29), preferably inlaid, painted on and/or stenciled, within or on the surface of one or more strips 22 of the synthetic turf layer 24. Alternatively, the features may be permanently formed on the playing surface 20 during the manufacturing process.

Figure 3:
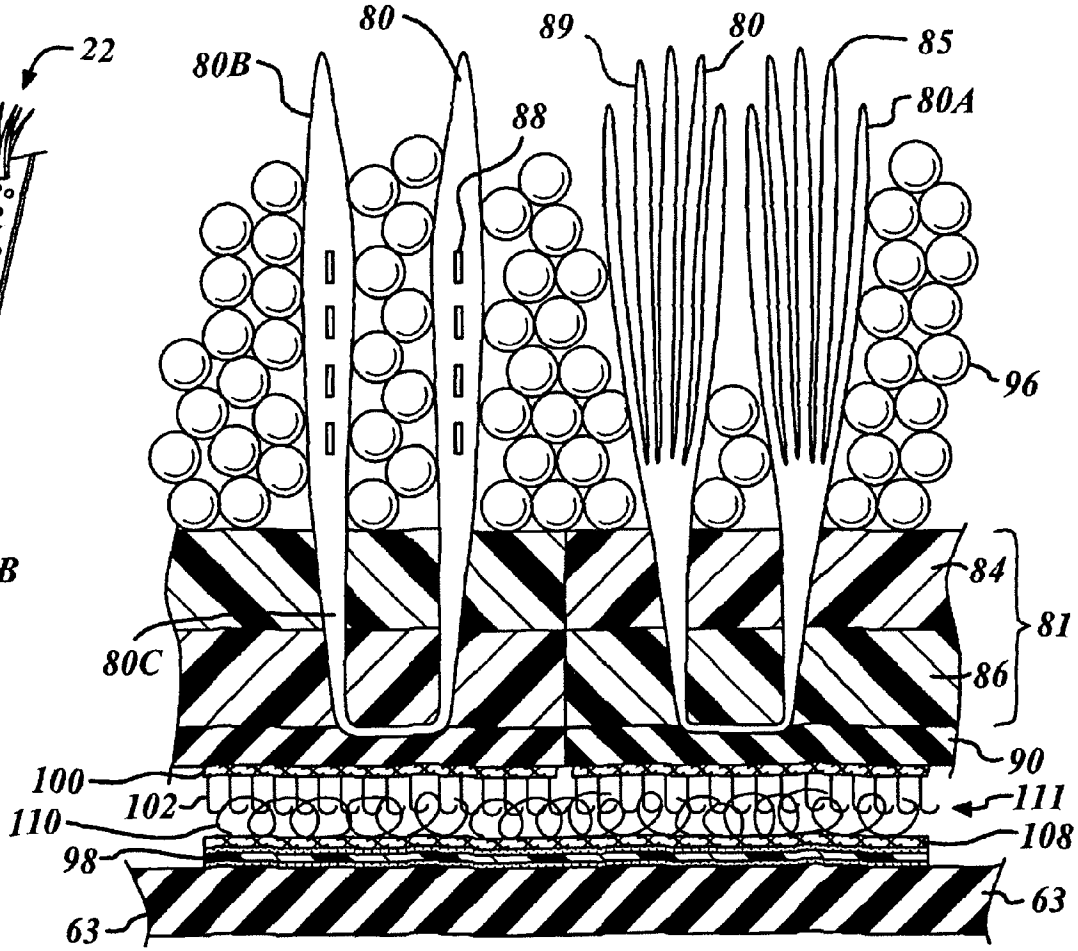
FIG. 3 is a section view of a portion of FIG. 2.
Figure 2:
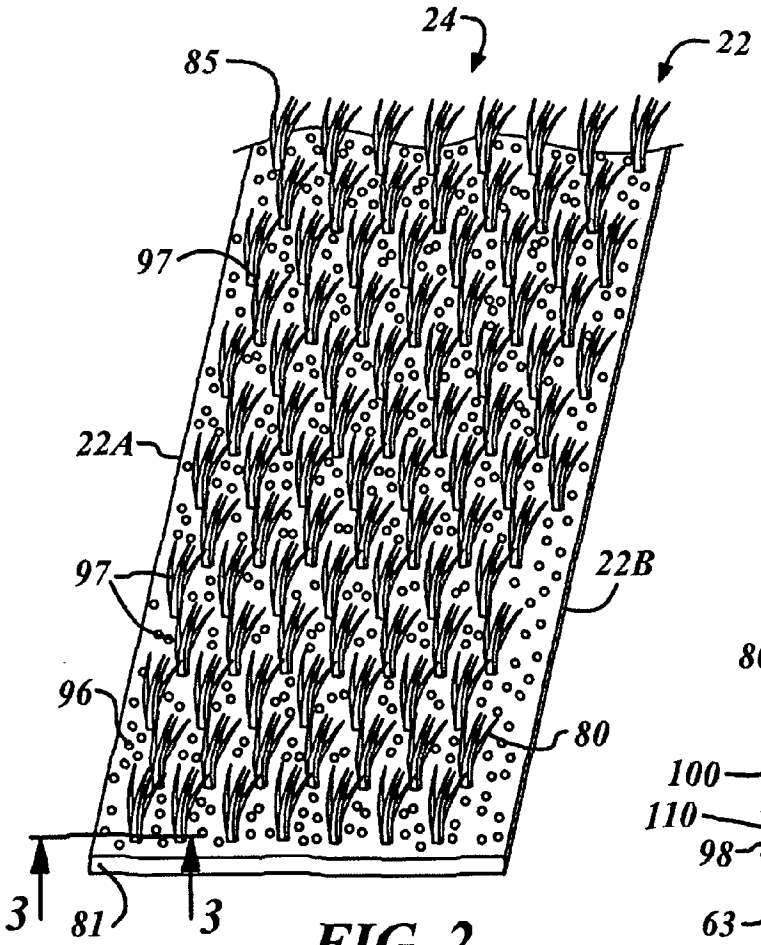
FIG. 2 is a perspective view of a portion of a synthetic grass strip of FIG. 1.
Figure 4:
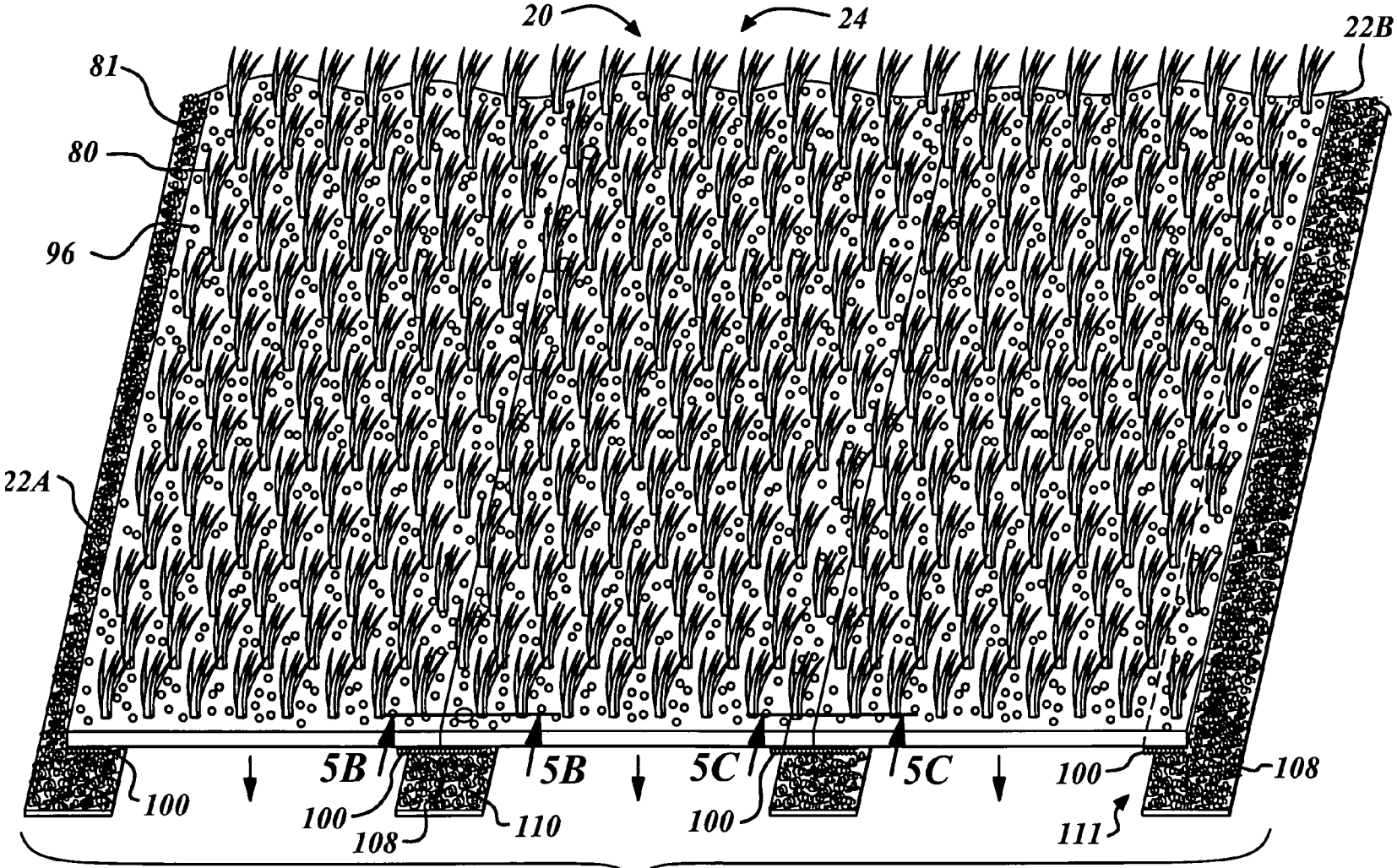
FIG. 4 is a perspective view of the synthetic turf grass surface according to one preferred embodiment of the present invention.

As best shown in FIGS. 2 and 3, the synthetic grass surface 24 has a plurality of fibrillated yarn strands 80 tufted (stitched) through a backing layer 81 in rows separated by a first distance, or gauge. The backing layer 81 preferably is a multi-layer backing layer consisting of at least two woven backing layers 84, 86. A secondary coating 90 is applied to the layer 86 to seal the strands 24 to the backing layer 81 and to add a layer of dimensional stability to the backing 81. The secondary coating 90 is applied at about 15 to 30 ounces per square foot, and more preferably about 20 ounces per square foot, onto the layer 86.

A layer of infill 96, preferably consisting of resilient particles, is then disposed interstitially among the strands 80 to a depth sufficient to maintain the strands in an upright position. The depth is less than the overall pile height of the strands 80 extending above the backing layer 81. Preferably, the infill 96 is applied to approximately 80 percent or more of the overall pile height of the strands 80.

The infill 96 is preferably composed of a mixture of cryogenically ground vulcanized scrap rubber and ambiently ground rubber having a sieve size of between approximately 8 and 30, and more preferably between 14 and 30, as measured by known ASTM standards in the industry. The infill may also consist of 100 percent cryogenically ground vulcanized scrap rubber, especially in outdoor applications. The cryogenically rubber is preferably 100 percent recycled post-consumer automobile tires, and therein provides an environmentally friendly use for these products. However, other cryogenically ground vulcanized rubber products that meet the desired specifications may be utilized as the infill 96, either alone or in combination with automobile tire rubber. For example, ground rubber recycled rubber may come from certain types of shoes. Further, other resilient particles such as cork may replace a portion of the cryogenically or ambiently ground rubber within the infill. In addition, depending upon the application, sand or other hard granules may be introduced in order to hold down the backing layers 84, 86, facilitate drainage, and reduce cost. Also, other hard particles, such as diatomaceous earth particles, may be introduced to the infill layer to facilitate drainage and possible act as an insecticide.

In one preferred embodiment, the backing layers 84, 86 is preferably two layers of a woven polypropylene/polyethylene material having a construction polypropylene warp fiber of 94 threads per 10 cm and a construction polyethylene weft fiber of 63 threads per 10 cm. One preferred backing material contains layers 84, 86 is Thiobac™, available from TC Thiolon USA™ of Dayton, Tenn.

As best shown in FIG. 2, the strands 80 are preferably fibrillated polyethylene fibers broken up into a plurality of blades 89 and having a blade thickness of about 80-110 microns, a fiber width of about 12 millimeters, and a pile length that varies from 0.5 to 2.5 inches, depending upon end use. To contrast the difference, a fibrillated strand 80A is shown on the right of FIG. 3 while a strand 80B containing fibrils 88 is shown on the left side of FIG. 3. For outdoor football fields, longer pile lengths around 2 inches are preferred. For indoor applications, shorter pile lengths of about 2 inches are preferred.

Two preferred strands 80 particularly suited for football fields are Thiolon XP™ and Thiolon LSR™ fibrillated polyethylene strands, each available from TC Thiolon USA™ of Dayton, Tenn. The Thiolon XP™ does not have as many fibrils as the Thiolon LSR™ strand, therein producing a thicker, heartier blade when fully fibrillated.

In conjunction with pile length, blade thickness, and fiber width, the strands 80 have a certain mass per unit length, or denier, that contributes to the overall plushness and playability of the field. Larger deniers equate to strands 80 having a larger mass per unit length. Thus, where high plushness is desired, such as with sports surface such as football and soccer fields, the strands 80 have a denier of at least 10,000, while other non-sports related fields 20 may have deniers of less than 10,000. In one preferred embodiment, a denier of about 8,000 is utilized.

The strands 80, when applied to the backings 84, 86, will be configured to lay a particular way on the backing. In other words, the tufting process is performed such that the uppermost ends 85 of the strands 80 will naturally fall substantially in the same direction. The grain of the strip 22 can therefore be classified as "with the grain" or "against the grain", depending upon an observer's relative position. A "with the grain" positioning is thus defined wherein the uppermost end 85 of the strand 80 has fallen in a direction away from a viewer's eye relative to the tufted portion 80C of the strand, while an "against the grain" positioning is defined wherein the uppermost end 85 of the strand 80 falls towards a viewer's eye. The importance of this grain classification will become evident below.

In addition, the strands 80 are stitched into the backing layers 84, 86 at a stitch rate of between about 7 and 24 stitches per 3-inch period. The stitch pattern 97 of strands 80 within the backing layers 84, 86 may vary depending upon the desired look and plushness. For example, the strands 80 may be stitched in a substantially linear pattern, a "lazy s" pattern, a single herringbone or a double herringbone pattern. In particular, the single herringbone pattern and the double herringbone pattern are preferable for use on fields 20 having a crown sloping downward from the center to the sides 42, 43, 44, and 45.

The gauge, as people of ordinary skill in the carpeting understand, refers to the average distance between rows of fiber strands 80. The smaller the gauge, the more fibers per unit distance, and hence the plusher the field. In addition, a smaller gauge adds additional barriers to prevent the movement of the infill 96 during use, as additional rows of strands 80 physically prevent infill 96 movement. The strands 80 have a gauge of between ⅛ and ½ inch, depending upon they end use application of the field.

In a preferred embodiment of the transition turf playing surface 20 used as a football field in an indoor stadium, the grass surface 24 is formed using strand stitched in a parallel design with a gauge of about ½ inch, a pile height is 2 inches, and an infill depth of between about 1 and 1.75 inches, and more preferably between about 1.5 and 1.75 inches.

Strips 22 of the synthetic grass material 24 are placed (unrolled onto) on top of the shock resistant material 63, in rows across the field such that the respective edges 22A, 22B of adjacent strips 22 are substantially lined up. As best described further below, the adjacent strips 22 are aligned and coupled together using a hook and loop fastening system 111 in one of two preferred embodiments described further below.

The hook and loop fastening systems, commonly known by the tradename Velcro®, consists of a male (hook) portion, having a series of stiff little plastic hooks, and a female portion (loop) having a series of soft and fuzzy fabric loops. To couple the female and male piece together, the hooks of the male portion are simply pressed onto and cling to the loops of the female portion to form a reversible coupling.

To form the playing surface 20 in accordance with one preferred embodiment, as shown in FIGS. 4 and 5A-C, a male (hook) portion 100 of a hook and loop fastening system 111 is attached to the backing layer 81 along opposite edges 22A, 22B of each respective strip 22. The hooks 102 of the respective male portion 100 are positioned extending away from the backing layer 81 (shown as extending downward in FIGS. 4-5), while the outer edge 104 of the respective male portion 100 substantially abuts the respective edge 22A of the respective strip 22.

Figure 5A:
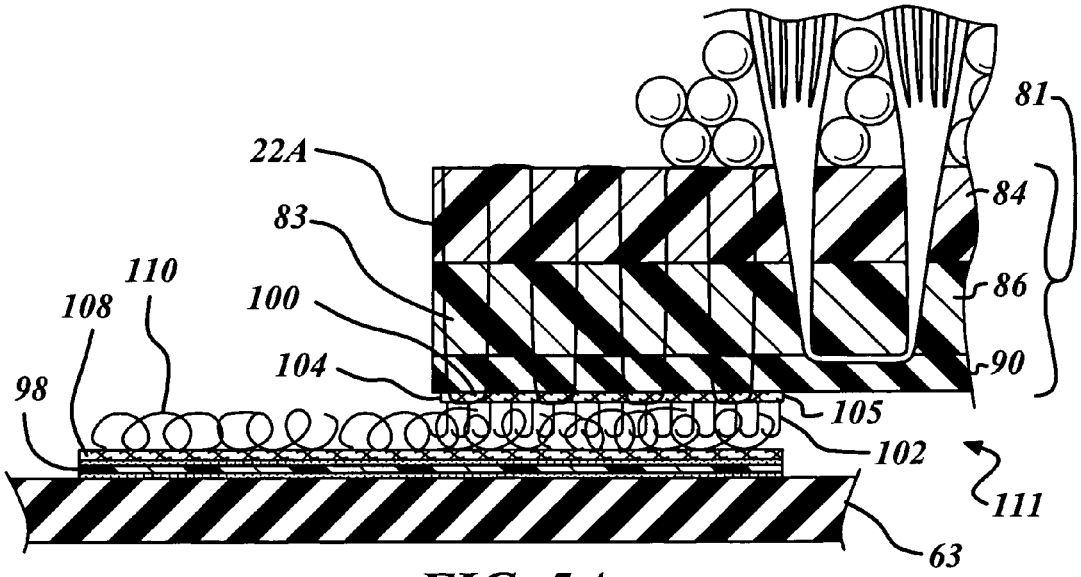
FIG. 5A is a section view of FIG. 4 taken along line 5A-5A.
Figure 5B:
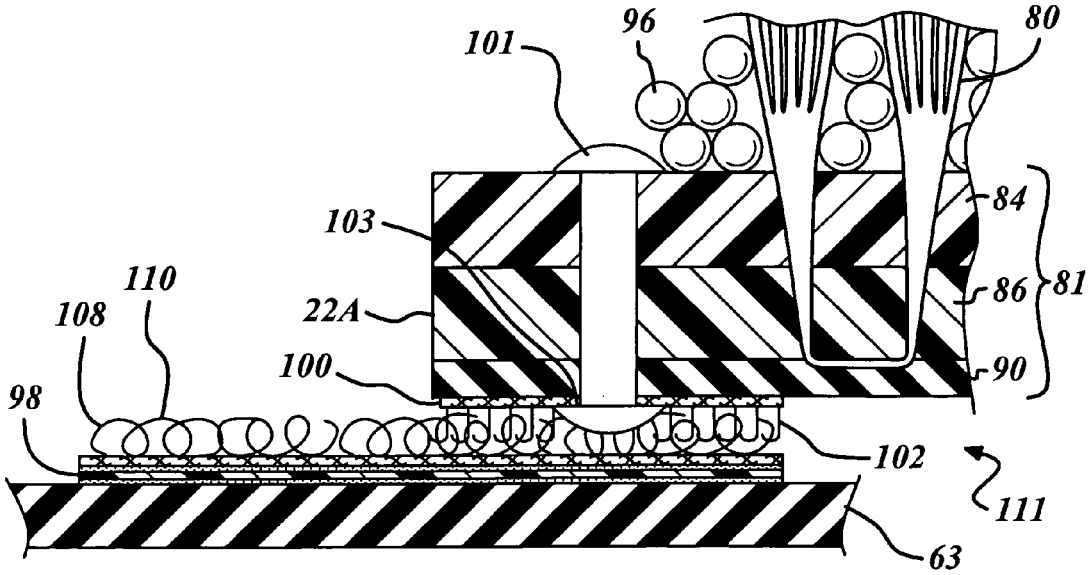
FIG. 5B is a section view of FIG. 4 taken along line 5B-5B.
Figure 5C:
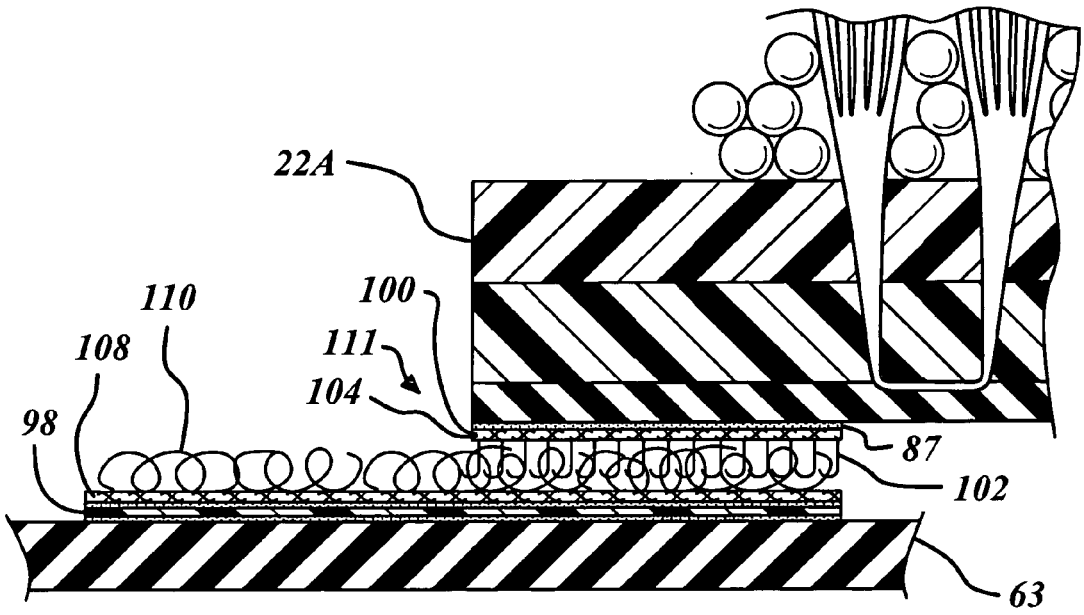
FIG. 5C is a section view of FIG. 4 taken along line 5C-5C.

The attachment of the male portion 100 to the backing layer 81 may be accomplished in many different ways that are each illustrated in FIGS. 5A-C. Preferably, as shown in FIG. 5A, the inner edge 105 and outer edge 104 of the male portions 100 are sewn to the backing layer 81 using nylon thread 83. A straight bag stitch is preferably utilized.

Alternatively, as shown in FIG. 5B, the male portions 100 may be attached using a mechanical fastener 101. One preferred mechanical fastener 101 utilizes ⅜-inch grommets with mechanical fasteners that are attached every six inches through a center portion 103 of respective male portion 100. As one of ordinary skill recognizes, many other types of mechanical fasteners 101, including rivets, may be used and still fall within the spirit of the present invention.

Further, as shown in FIG. 5C, an adhesive 87 is applied between the backing layer 81 and the male hook portion 100 to adhere the backing layer 81 to the respective portion 100. One commercially available urethane adhesive material that may be used in Nordot® 34-G adhesive, available from Synthetic Surfaces Inc. of Scotch Plains, N.J.

While FIG. 5A-C shows each of the preferred methods, it should be noted that any of the three preferred methods may be utilized individually or in combination and thus are not limited to the illustrations shown in FIGS. 5A-C.

To couple together two adjacent strips 22, as shown further in FIGS. 4 and 5A-C, the strips 22 are first aligned along the shock resistant layer 63 (or substrate 64) such that the respective edges 22A, 104 substantially abut. The edges 22A, 104 are then peeled away from layer 63 and a female portion 108 of the hook and loop fastening system 111 positioned onto the shock layer 63 with the loops 110 protruding upwardly away from the layer 63.

The strips 22 are then returned to the normal position, allowing the hooks 102 of the male portion 100 to press down on the loops 110 of the female portion 108, therein reversibly coupling together the adjacent strips 22. A seam tape layer 98 may be placed beneath the female portion 108 to secure the female portion 108 to the shock layer 63. The process is repeated for each adjacent strip 22.

Of course, while not shown, the positioning of the male portion 100 and female portion 108 may be reversed, wherein the respective female portions 108 are coupled to the strips 22 and the male portions 100 are coupled to the seam tape layer 98, and still fall within the spirit of the present invention. In this preferred embodiment, the female portions 108 are coupled to the backing layer 81 in a method similar to FIGS. 5A-C above and such that the loops 102 protrude away from the backing layer 81 towards the substrate 64.

The infill 96 is introduced on top of the backing layer 81 at a thickness commensurate with the pile length of the strands 80 that allows the uppermost end 85 to extend above the thickness of the infill 96. As described above, the preferred depth of the infill 96 is at least ⅘ of the pile height of the strands 80.

In accordance with another preferred embodiment, as shown in FIGS. 6 and 7A-C, the playing surface 20 is formed by first attaching a male (hook) portion 100 of a hook and loop fastening system 111 to the backing layer 81 along one edge 22A or 22B of the respective strip 22. The hooks 102 of the respective male portion 100 are positioned extending away from the backing layer 81 (shown as extending downward in FIGS. 6 and 7A-C), while the outer edge 104 of the respective male portion 100 substantially abuts the respective edge 22A or 22B of the respective strip 22.

Figure 7A:
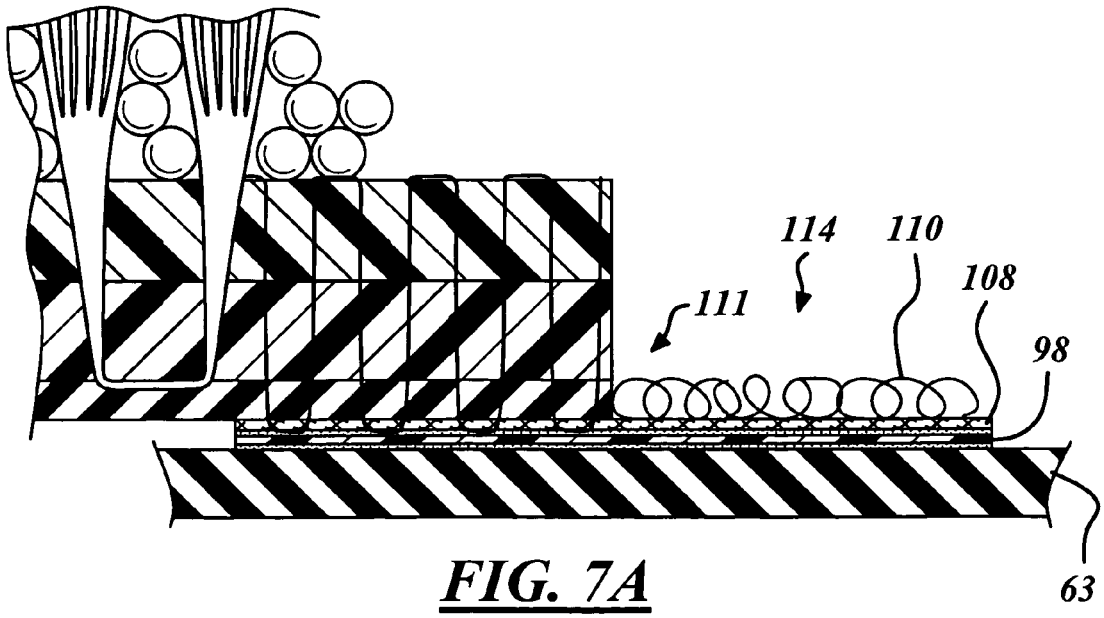
FIG. 7A is a section view of FIG. 6 taken along line 7A-7A.
Figure 6:
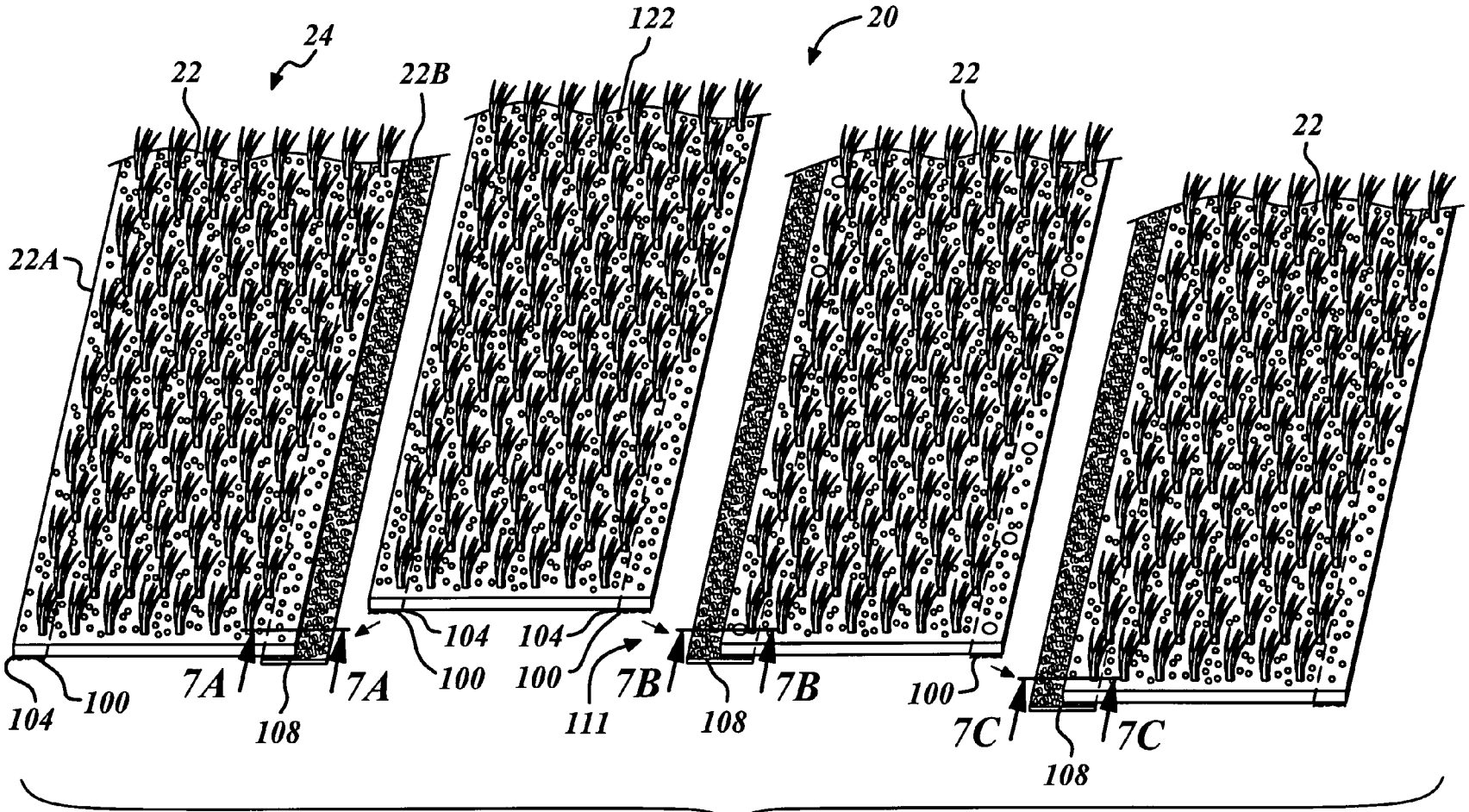
FIG. 6 is a perspective view of the synthetic turf grass surface according to another preferred embodiment of the present invention.
Figure 7B:
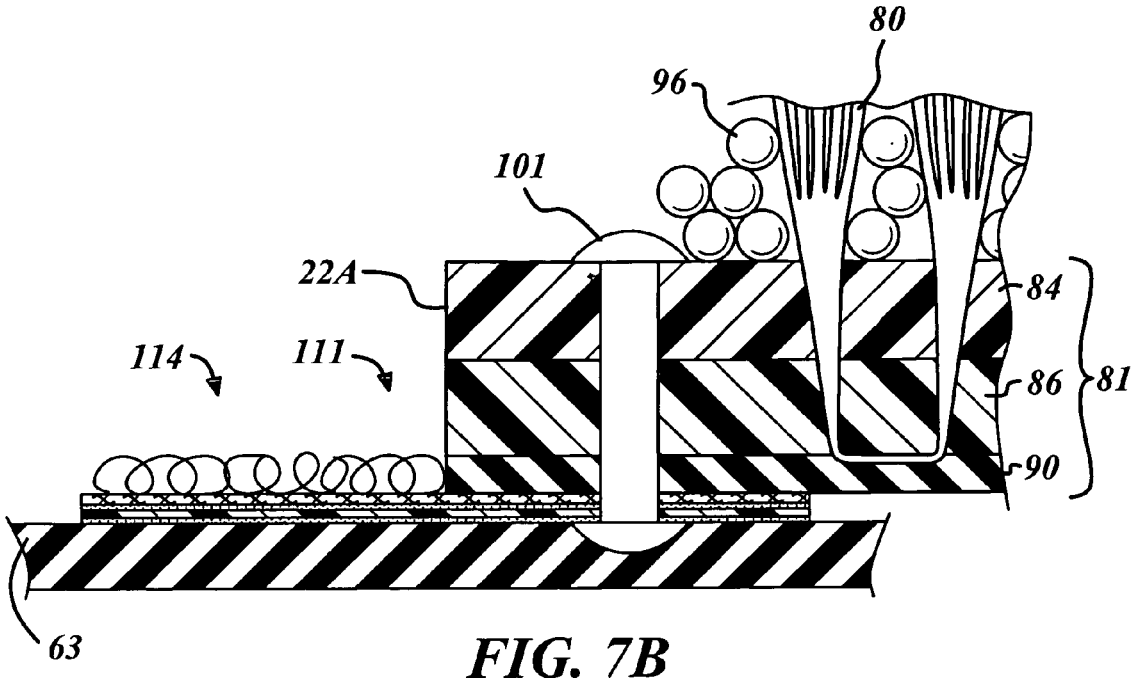
FIG. 7B is a section view of FIG. 6 taken along line 7B-7B.
Figure 7C:
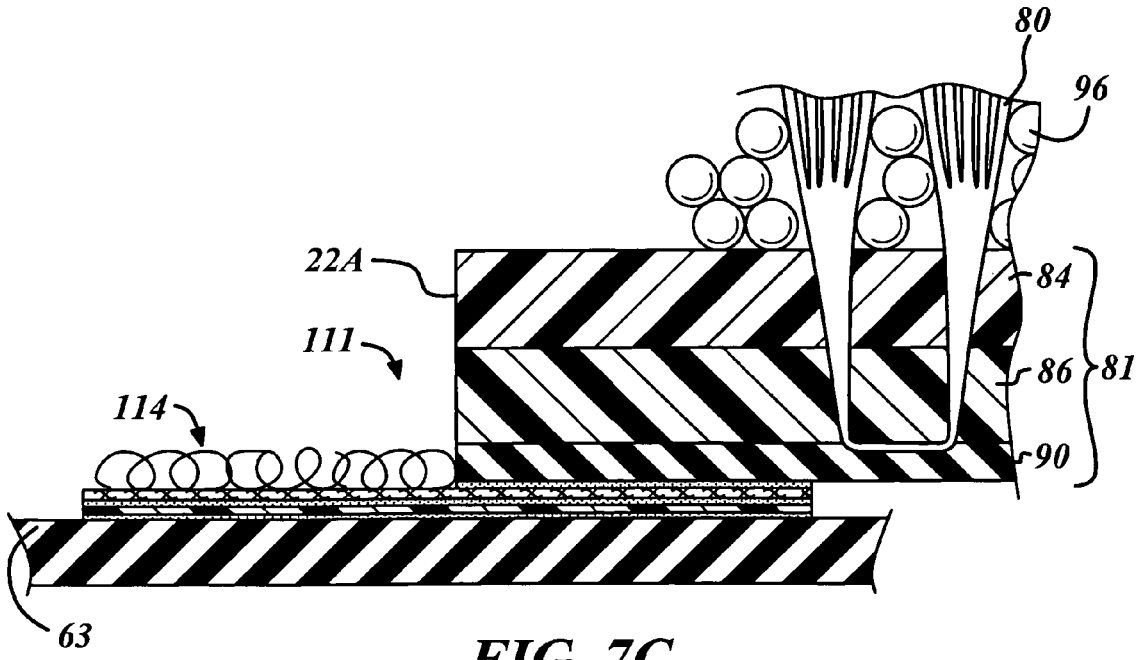
FIG. 7C is a section view of FIG. 6 taken along line 7C-7C.

A female portion 108 of the hook and loop fastening system 111 is coupled to another respective edge 22A or 22B located on the opposite side of the one edge 22A or 22B. The female portion 108 is attached in a manner similar to the male portion 100 but with the loops 110 protruding towards to backing layer 81 (upwardly in FIGS. 6 and 7A-C). Thus, as shown in FIG. 7A, the female portion 108 is preferably sewn to the backing layer 81 using nylon thread 83. Alternatively, as shown in FIGS. 7B and 7C, the female portion 108 may also be coupled to the backing layer 81 using a mechanical fastener 101 or via an adhesive layer 87.

Similar to FIG. 5A above, as shown in FIG. 7A, the male portion 100 is preferably also attached to the backing layer 81 using nylon thread 83. Of course, the male portion 100 may also be attached utilizing mechanical fasteners 101 and/or adhesive material 87 as best shown in FIGS. 7B and 7C.

In addition to the attachment methods described above, a portion 114 of the female portion 108 extends outwardly beyond the respective edge 22A 22B of the strip 22.

A central strip 122 is also formed in a similar manner in which male portions 108, or female portions 100, are coupled to each respective edge 122A, 122B.

To form the transition turf field 20, as shown in FIGS. 6 and 7A-C, the optional shock layer 63 is first placed onto the flooring material 64. Next, the central strip 122 is unrolled onto the shock layer 63 in a predetermined position.

The next adjacent strip 22 is then unrolled next to the central strip 122 such that the female portion 108 (or male portion 100) of the strip 122 abuts the edge 22A of the adjacent strip 22. The hooks 102 of the male portion 100 of the central strip 122 hooks onto the loops 110 of extended portion 114 of the female portion of the adjacent strip 22. Conversely, the loops 110 of the female portion 108 of the central strip 122 may abut the male portion 100 of the next adjacent strip 22 such that the hooks 102 are coupled to the respective loops 110. The hook and loop fastening system 111 thus secures the strip 22 to the central strip 122. The same process is then repeated on the opposite side 122B of the central strip 122 utilizing another strip 22.

Next, the male portion 100 of each of the adjacent strips 22 is hooked into the extended portion 114 of the female portion 108 of each additional strip 22 such that the ends 22A of each adjacent strip 22 are substantially aligned.

The infill 96 is introduced on top of the backing layer 81 at a thickness commensurate with the pile length of the strands 80 that allows the uppermost end 85 to extend above the thickness of the infill 96.

Figure 8:
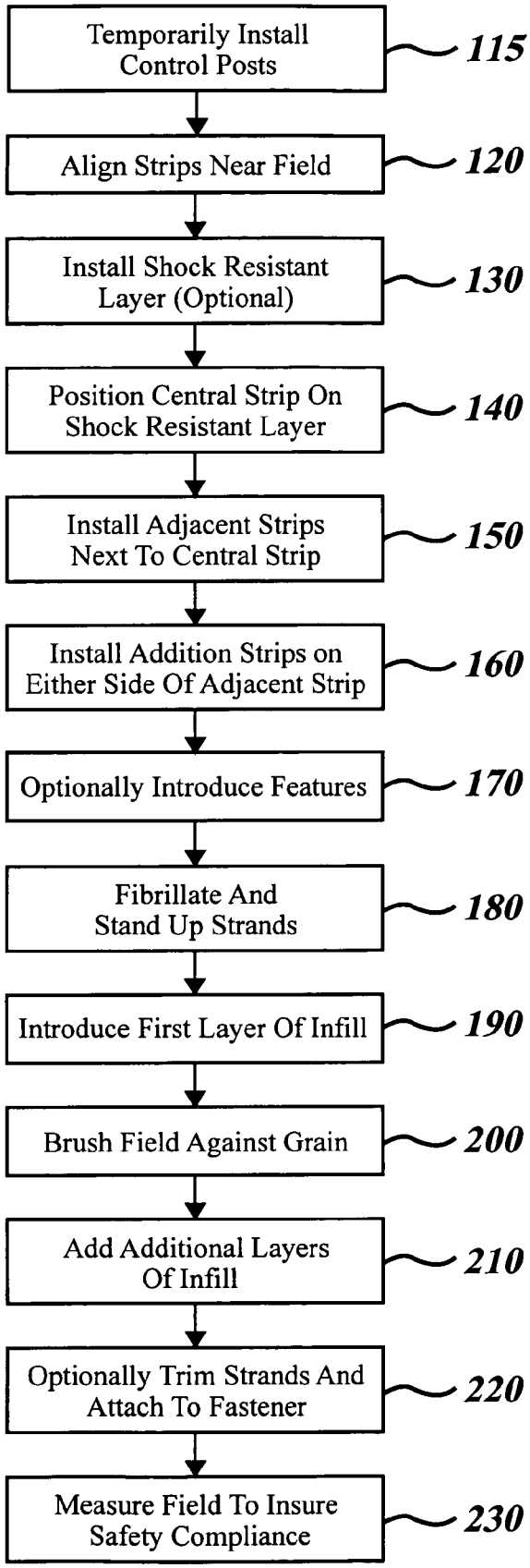
FIG. 8 is a logic flow diagram for assembling the sports field of FIG. 1.

A logic flow diagram for installing the transition turf sports field according to the present invention is shown as FIG. 8 illustrated in the preceding paragraphs. The process strips formed in accordance with the preferred embodiments described above and further assumes installation in an indoor sports facility that is to be placed onto a firm and level surface such as a concrete floor or onto a concrete floor. The process can be utilized for either preferred embodiment described above.

In Step 115, a series of control posts are temporarily installed into the concrete floor at predetermined positions using laser sights. The location of the control posts is determined from monuments or other location markers (such as painted on lines on a concrete floor) typically installed prior to commencement of installation of the sports field. For example, in the case of a football field, the posts are positioned in areas representing yard lines, hash marks, end zones, and sidelines.

In Step 120, strips 22, 122 are moved from storage using a Zamboni or forklift and aligned near the field in the preferred order. Alternatively, the strips 22, 122 could be removed from storage one at a time after step 130 below.

In Step 130, the optional shock resistant layer 63 is placed onto the flooring surface. Typically, this is done by unrolling the shock resistant layer 63 from a PVC pipe or similar storage roll.

In Step 140, the first strip 22, or central strip 122, is positioned at a predetermined location using the control posts at the center of the field on the shock layer 63. The first strip 22 or central strip 122 is laid such that the secondary coating 90 is closely coupled to the shock pad 63 while the upper ends 85 of the strands 80 are located at the further point away from the shock pad 63.

Next, in Step 150, an adjacent strip 22 is coupled to either the first strip 22, in a procedure described above with respect to the embodiment of FIGS. 4 and 5A-C, or to the central strip 122, in a procedure described above with respect to FIGS. 6 and 7A-C.

In Step 160, another strip 22 is added to each side 22A of the next adjacent strip 22, 122. The process is repeated until the entire width of the field is covered with the strips 22, 122.

In the case of a football field, the strips 22, 122 are laid wherein the grain lies in the same direction across the length l of the field (i.e. wherein the appearance of the field as observed by a person on a first side is either "with the grain" or "against the grain"). For example, the strips 22 are all laid in a "against the grain" pattern with respect to a first lengthwise end 44 of the field 20, wherein an observer standing along a first lengthwise side would be able to see tops of the uppermost ends 85 of the strands. As one of ordinary skill recognizes, people viewing the field 20 from the first lengthwise end 44 would thus view the field as having a darker, plusher appearance, while people viewing the field from the second lengthwise end 45 would observe a shinier, less plush appearance, wherein the topmost end 85 lays in a direction away from the observer.

Alternatively, the strips 22 may be laid in an alternating "against the grain"/"with the grain" approach so as to simulate a freshly mowed grass surface. In addition, the strips 22 are preferably laid such that the seams 49 defined between adjacent strips 22,22 and 22,122 extending from the first lengthwise end 44 to the second lengthwise end 45 are staggered with respect to each other.

Further, the strips 22 of grass constituting the sideline are preferably laid in an orientation perpendicular to the strips 22 constituting the football playing field.

Next, in Step 170, if desired, the features 29 are introduced to portions of the strips 22, 122 by either the inlaying or stenciling process described above. More preferably, the strips 22 are formed with the features 29 at the time of manufacture prior to the first installation.

Next, in Step 180, a mechanical rotary brush (not shown) is introduced to the strands 80 to fibrillate and stand up the strands on top of the backing layers 84, 86. This is done by moving the mechanical brush in a direction "against the grain" on the strands 80. This breaks the fibrils 85 contained on the strands 80, therein converting on strand 80 into many separate blades 89, therein giving the grass surface 24 a plusher, more natural grass-like look. A lawn sweeper (not shown), preferably a Parker Lawn Sweeper, is then introduced to remove loose fibers, glue, contaminants, or other debris from the field 20 (i.e. clean the surface).

In Step 190, a first layer of cryogenically ground rubber infill 96 is introduced onto the football field using a top dressing unit (not shown). The composition of the infill 96 is dependent upon the ultimate use for the field 20.

After introducing the first amount of infill 96, in Step 200, the football field is brushed "against the grain" with a mechanical rotary brush and then brushed with a grooming brush. One preferred grooming brush is the Sweepmaster Turf Brush, sold by Gandy Products of Owatonna, Minn.

Next, in Step 210, one or more additional layers of infill 96 are added such that the tops of the blades 24A are exposed through the infill 96. The grooming brush grooms and levels the infill 96 to a desired thickness over the backing layer 81.

In Step 220, the strips 22 are optionally trimmed along the edges 42, 43 and sides 44, 45 and attached to a polywood fastener 25 that extends around the field 20. The polywood fastener 25 abuts and is coupled to the concrete curb 27. This prevents the field strips 22 from shifting during play. The preferred method of attachment is via wood screws and metal washers. The field 20 is then ready for use.

Next, in Step 230, the field 20 is preferably measured using various ASTM standards to ensure compliance with safety requirements. This is done at a wide variety of predetermined locations to ensure uniformity. For example, a football field 20 must have a certain amount of bounce, as measured by ASTM standard F355, in which missile is dropped onto the field to determine the amount of bounce. Currently, football fields must have a bounce not to exceed 175.

As one of ordinary skill recognizes, due to the use of a loose infill 96, it is highly desirous to perform routine maintenance upon the field 20. This includes removing loose debris with a sweeper and measuring infill 96 thickness to ensure proper thickness.

The field 20 is removed in substantially the same manner by first moving the male portion 100 of one strip 22 upward such that it is unhooked from the respective male portion 106. The unhooked strips 22 are then re-rolled, one at a time, onto a PVC pipe and transported to a storage area. The rolled strips contain the infill material. Any portion of the infill that is not retained within the rolled up strips is swept up or vacuumed and replaced onto the transition turf 20 during the next installation.

The present invention thus discloses a transition turf field that is easily installed and removed and is ideal for use in indoor, multiuse sports and entertainment facilities that require a multitude of different flooring surfaces.

While the invention has been described in terms of preferred embodiments, it will be understood, of course, that the invention is not limited thereto since modifications may be made by those skilled in the art, particularly in light of the foregoing teachings.

What is claimed is:

1. A transition turf field comprising:

(a) a discrete shock resistant layer applied over top of a substrate, said shock resistant layer having an upper surface and a lower surface;

(b) a first strip of a synthetic grass material having a bottom surface placed onto said upper surface of said shock resistant layer, said first strip of synthetic grass material comprising a plurality of layers of an all-woven backing material; a plurality of fibrillated synthetic grass strands tufted through said all-woven backing material such that said ends of said plurality of fibrillated strands extend above said all woven backing material at a first height; and a secondary coating coated to a bottommost one of said plurality of layers of said backing material such that a tufted portion of said plurality of fibrillated synthetic grass strands is contained between said secondary coating and said bottommost one of said plurality of layers of said backing material, said first strip further comprising a first portion of a hook and loop fastening system coupled to said bottom surface of said first strip of said synthetic grass material such that said secondary coating is located between said first portion and said bottommost one of said plurality of layers, said first portion selected from the group consisting of a male portion and a female portion, wherein a portion of said first portion of said hook and loop fastening system extends beyond an edge of said first strip and is therefore not abutting said secondary coating of said first strip and wherein said first portion coupled to said first strip does not abut the entirety of said secondary coating, said first portion of said hook and loop fastening system faces upwardly and covers at least said portion that extends beyond said edge of said first strip;

(c) a second strip of said synthetic grass material placed onto said upper surface of said shock resistant layer, said second strip further comprising a second portion of said hook and loop fastening system coupled to said bottom surface of said second strip of said synthetic grass material such that said secondary coating is located between said second portion and said bottommost one of said plurality of layers of said second strip and wherein said second portion coupled to said second strip does not abut the entirety of said secondary coating, said second portion selected from the group consisting of said male portion and said female portion and wherein the first and second portions together do not abut the entirety of the secondary coating on each first and second strips, wherein said second portion comprises said male portion when said first portion comprises said female portion and wherein said first portion comprises said male portion when said second portion comprises said female portion;

wherein said first portion of said first portion of said hook and loop fastening system is coupled to said second portion of said hook and loop fastening system of said second strip of said synthetic grass material;

(d) an infill layer placed onto said first strip and said second strip, wherein the thickness of said infill layer is less than said first height of said first strip and said second strip, said infill layer comprising a plurality of resilient particles.

2. The transition turf of claim 1, wherein said first strip further comprises said first portion of another hook and loop fastening system coupled to said first strip of said synthetic grass material such that said secondary coating is located between said first portion and said bottommost one of said plurality of layers, wherein another portion of said secondary coating is not coupled to either of said hook and loop fastening system or said another of said hook and loop fastening system; said first portion of another hook and loop fastening system faces upwardly.

3. The transition turf of claim 1, wherein said second strip further comprises said first portion of another hook and loop fastening system coupled to said second strip of said synthetic grass material such that said secondary coating is located between said first portion and said bottommost one of said plurality of layers of said second strip, wherein another portion of said secondary coating is not coupled to either of said hook and loop fastening system or said another of said hook and loop fastening system.

4. The transition turf of claim 2 further comprising:

(e) a third strip of said synthetic grass material placed onto said optional shock resistant layer, said third strip further comprising said second portion of a hook and loop fastening system coupled to said third strip of said synthetic grass material such that said secondary coating is located between said second portion and said bottommost one of said plurality of layers, wherein a portion of said second portion of said hook and loop fastening system extends beyond an edge of said third strip and is therefore not abutting said secondary coating of said third strip and wherein said second portion coupled to said third strip does not abut the entirety of said secondary coating;

wherein said portion of said second portion of said hook and loop fastening system of said third strip of said synthetic grass material is coupled to said first portion of said hook and loop fastening portion of said first strip of said synthetic grass material.

5. The transition turf of claim 1, wherein said infill layer comprises a mixture of cryogenically ground vulcanized rubber scrap particles and ambiently ground rubber particles.

6. The transition turf of claim 5, wherein said mixture has a sieve size between about 8 and 30 mesh.

7. The transition turf of claim 5, wherein said mixture has a sieve size between about 14 and 30 mesh.

8. The transition turf of claim 1, wherein said thickness of said infill layer comprises at least 80 percent of said first height above said all woven backing material.

9. The transition turf of claim 1, wherein the gauge of said plurality of fibrillated synthetic grass strands tufted through said all-woven backing material is between about ⅛ and ½ inch.

10. The transition turf of claim 1, wherein the stitch rate of said plurality of fibrillated synthetic grass strands tufted through said all-woven backing material is between about 7 and 24 stitches per 3-inch period.

11. The transition turf of claim 1, wherein each strand of said plurality of fibrillated strands has a denier between about 8,000 and 10,000.

12. The transition turf of claim 1 further comprising: (e) a polywood fastener coupled to said synthetic grass material.

13. A method for forming a transition turf field comprising:

(a) providing a substrate;

(b) introducing a discrete shock resistant layer over top of said substrate;

(c) forming a plurality of strips of a synthetic grass material, each of said plurality of strips comprising a plurality of layers of an all-woven backing material; a plurality of fibrillated synthetic grass strands tufted through said all-woven backing material such that said ends of said plurality of fibrillated strands extend above said all woven backing material at a first height; and a secondary coating coated to a bottommost one of said plurality of layers of said backing material such that a tufted portion of said plurality of fibrillated synthetic grass strands is contained between said secondary coating and said bottommost one of said plurality of layers of said backing material; each of said plurality of strips having a top surface from which said plurality of fibrillated synthetic grass strands extend and a bottom surface that lies over top of said discrete shock resistant layer;

(d) coupling a first portion of a hook and loop fastening system to the bottom surface of each respective one of said plurality of strips such that said secondary coating is located between said first portion and said bottommost one of said plurality of layers and wherein said first portion does not abut the entirety of said secondary coating on each respective one of said plurality of strips, said first portion of said hook and loop fastening system faces upwardly and covers at least said portion that extends beyond said edge of said first strip; and (e) coupling a second portion of said hook and loop fastening system to a bottom portion of said each respective one of said plurality of strips such that said secondary coating is located between said second portion and said bottommost one of said plurality of layers and wherein said second portion does not abut the entirety of said secondary coating on each respective one of said plurality of strips and wherein said first portion and said second portion together do not abut the entirety of said secondary coating on each respective one of said plurality of strips, wherein a portion of said second portion of said hook and loop fastening system extends beyond an edge of said first strip and is therefore not abutting said secondary coating of said first strip, said first portion and said second portion being selected from the group consisting of a male portion and a female portion, wherein said second portion comprises said male portion when said first portion comprises said female portion and wherein said first portion comprises said male portion when said second portion comprises said female portion;

(f) placing a first strip of said plurality of strips onto said substrate over said shock resistant layer;

(g) placing another strip of said plurality of strips onto said substrate over said shock resistant layer such that said first portion of said another strip of said plurality of strips is reversibly coupled to said portion of said second portion of said hook and loop fastening system of said first strip of said plurality of strips that extends beyond said edge of said opposite side;

(h) placing a third strip of said plurality of strips over said shock resistant layer such that said first portion of said third strip is reversibly coupled to said second portion of said first strip;

(i) introducing a fourth strip of said plurality of strips over said shock resistant layer such that said first portion of said fourth strip is reversibly coupled with said second portion of said third strip;

(j) introducing a layer of infill onto said all-woven backing material to a second height, said second height being less than said first height, said layer of infill comprising a plurality of resilient particles having a mesh size between about 8 and 30; and (k) coupling said synthetic grass system to a polywood fastener such that said discrete shock resistant layer is disposed between said plywood fastener and said bottom surface of each of said plurality of strips.

14. The method of claim 13, wherein (j) introducing a layer of infill onto said plurality of strips and each of said plurality of adjacent strips to a second height comprises (j) introducing a layer of infill onto said plurality of strips and each of said plurality of adjacent strips to a second height, said second height less than said first height, said second height being at least about 4/5 of said first height, said layer of infill comprising a plurality of resilient particles having a mesh size between about 8 and 30.

* * * * *